US005807143A

United States Patent [19]

Wagener

[11] Patent Number: 5,807,143

[45] Date of Patent: Sep. 15, 1998

[54] CONNECTING TERMINAL

[75] Inventor: Hans Wagener, Dietzhölztal, Germany

[73] Assignee: Rittal-Werk Rudolf Loh GmbH & Co. KG, Herborn, Germany

[21] Appl. No.: 785,139

[22] Filed: Jan. 13, 1997

[30] Foreign Application Priority Data

Jan. 17, 1996 [DE] Germany ..... 196 01 457.3

[51] Int. Cl.[6] ..... H01R 4/30

[52] U.S. Cl. ..... 439/803

[58] Field of Search ..... 439/100, 213, 439/792, 803; 24/335, 486; 269/86, 87.2, 249

[56] References Cited

U.S. PATENT DOCUMENTS 5,286,211 2/1994 McIntosh ..... 439/803 X

FOREIGN PATENT DOCUMENTS 3510210 1/1987 Germany .
8629688 2/1987 Germany .
3942953 6/1991 Germany .
9304297 8/1993 Germany .
4432756 3/1995 Germany .

*Primary Examiner*—Khiem Nguyen
*Attorney, Agent, or Firm*—Speckman Pauley Petersen & Fejer

[57] ABSTRACT

A connecting terminal for a busbar and a connecting cable having a hook strap which can be pushed on the busbar. A clamping strap can be adjusted by an attachment screw which clamps the connecting cable to the busbar. A holding strap provisionally holds the hook strap pushed on the busbar. The cost of parts and assembly can be reduced without interference with the function because the holding strap is pushed from the direction of an outside on a transverse leg of the hook strap and extends with lateral legs that act as holding springs, into receivers of the lateral legs of the hook strap. The holding strap has a through-bore for the attachment screw. A transverse leg of the holding strap extends on both sides past the hook strap and forms receivers for adjustable fixing of the lateral legs of the clamping strap which is inserted between the lateral legs of the hook strap.

12 Claims, 2 Drawing Sheets

CONNECTING TERMINAL

BACKGROUND OF THE INVENTION

1. Field of the Invention

This invention relates to a connecting terminal for a busbar and a connecting cable having a hook strap which can be pushed on the busbar, a clamping strap which can be adjusted by an attachment screw which clamps the connecting cable to the busbar, and a holding strap which provisionally holds the hook strap pushed on the busbar.

2. Description of Prior Art

A connecting terminal of a similar type is known from German Patent Publication DE 39 42 953 C2. This known connecting terminal has the advantage of being easy to fix on wide busbars and permitting the connection of the connecting cable, wherein a provisional holding of the connecting terminal is already achieved when the connecting terminal is pushed on the busbar. Not only is the connecting cable clamped to the busbar while tightening the attachment screw, but the seating of the connecting terminal on the busbar is also improved.

However, this known connecting terminal requires increased costs for parts and assembly. The holding strap is supported by a spring on the transverse leg of the hook strap, wherein the attachment screw is guided through a bore in the transverse leg of the holding strap and is supported on a lateral leg of the clamping strap. It is necessary for the attachment screw to be guided non-adjustably, but freely rotatable in the other lateral leg of the attachment screw, so that while displacing the transverse leg of the hook strap it also takes the clamping strap along and the holding strap can perform the required yielding movements when the busbar is inserted. In addition to the three straps, this embodiment of the connecting terminal requires a spring and a support washer.

A connecting terminal for a busbar is also known from German Patent Publication DE 93 04 297 U1. This known connecting terminal also uses a hook strap as the base element. A contact strap is screwed to the transverse leg of the hook strap. An attachment screw is used for the screw connection. One lateral leg of the contact strap is located at a distance from the transverse leg of the hook strap and the other lateral leg projects into the receivers of the lateral legs of the hook strap. The connecting cable supports a cable bracket and is fastened to the contact strap by the attachment screw. The distance between the lateral leg of the contact strap and the transverse leg of the hook strap determines the clamping path of the connecting terminal. So that the connecting terminal can be provisionally fixed on the busbar, a spring element is pushed on the free end legs of the lateral legs of the holding strap.

SUMMARY OF THE INVENTION

It is one object of this invention to provide a connecting terminal of the species mentioned at the outset which is of simpler construction, requires fewer parts and is easier to mount, wherein there is no interference with the function.

In accordance with this invention the above and other objects are attained with a holding strap that is pushed from the direction of the outside on the transverse leg of the hook strap, that extends with its lateral legs which constitute holding springs into the receivers of the lateral legs of the hook strap, and that has a through-bore for the attachment screw. The transverse leg of the holding strap extends on both sides past the hook strap and forms receivers for adjustable fixing of the lateral legs of the clamping strap inserted between the lateral legs of the hook strap.

With this arrangement of the three straps the spring can be omitted, and by its dimensions the hook strap permits the insertion of connecting cables of various thicknesses. The three straps of the novel connecting terminal can be mounted in a simple manner and the connecting terminal nevertheless fulfills all functions of the known connecting terminal.

In one preferred embodiment, the lateral legs of the holding strap are inserted only in an area of the receivers in the lateral legs of the hook strap as far as the area of the receivers. The ends of the lateral legs of the holding strap have bevels in an area of the receivers, which simultaneously form holding springs and urge the holding strap on the hook strap. Thus, the holding strap can be locked on the hook strap.

Receivers for lateral legs of the clamping strap are formed by slits cut into the extensions of the transverse leg of the holding strap, through which extensions of the lateral legs of the clamping strap are guided. The extensions of the lateral legs of the clamping strap are matched to a maximum displacement path of the clamping strap.

The clamping strap can be fixed captively on the holding strap by extensions of the two lateral legs of the clamping strap which are at a distance which is greater than the distance between the slits in the extensions of the transverse leg of the holding strap.

According to one preferred embodiment, the transverse leg of the clamping strap disposed between the lateral legs of the hook strap is beveled in such a way, that in a direction toward the receivers of the lateral legs of the hook strap it forms an obtuse-angled contact surface. It is thus possible to clamp particular round connecting cables solidly and definitely to the flat busbar.

The holding strap is sufficiently held on the hook strap because the distance between the holding springs of the holding strap is greater than the distance between the inner walls of the lateral legs of the hook strap, but less than the distance between the outer walls of the lateral legs of the hook strap.

If the layout is such that the width of the clamping strap is matched to the distance between the inner walls of the lateral legs of the hook strap, it is possible to use the entire space between the lateral legs of the hook strap for clamping one or several connecting cables.

This invention will be explained in greater detail in view of a preferred embodiment represented in the drawings.

DETAILED DESCRIPTION OF PREFERRED EMBODIMENTS

Figure 1:
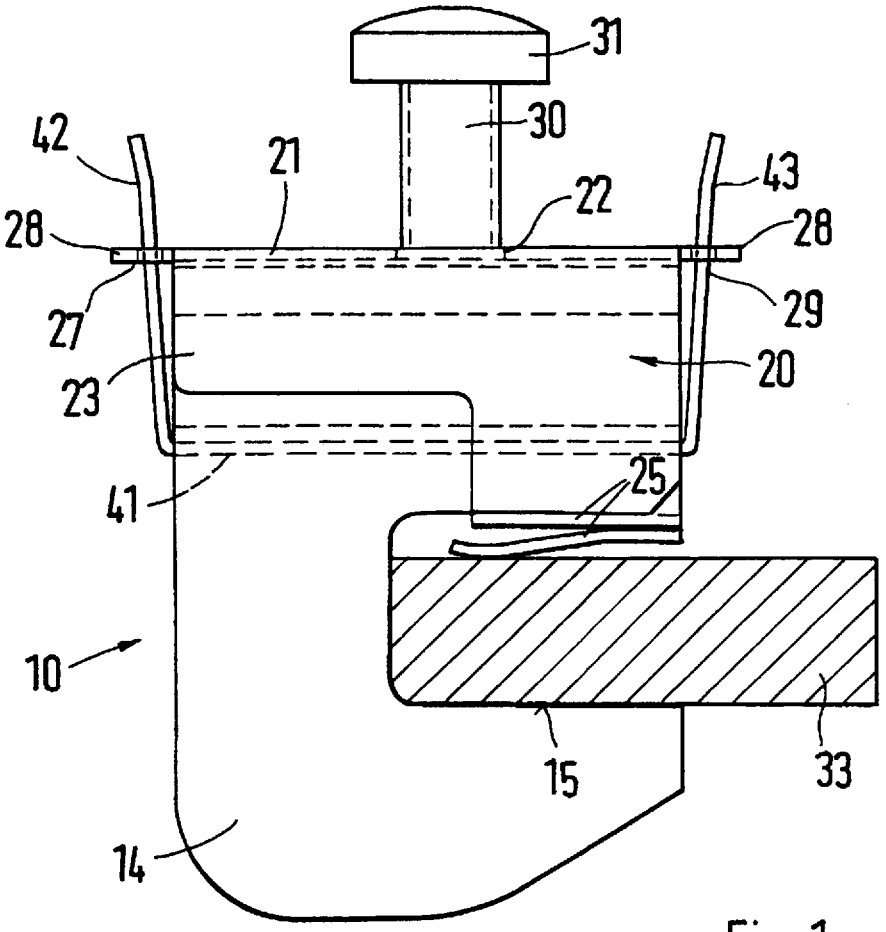
FIG. 1 is a side partial cross-sectional view of a connecting terminal in accordance with one preferred embodiment of this invention in a position where the connecting terminal is pushed on a busbar.
Figure 2:
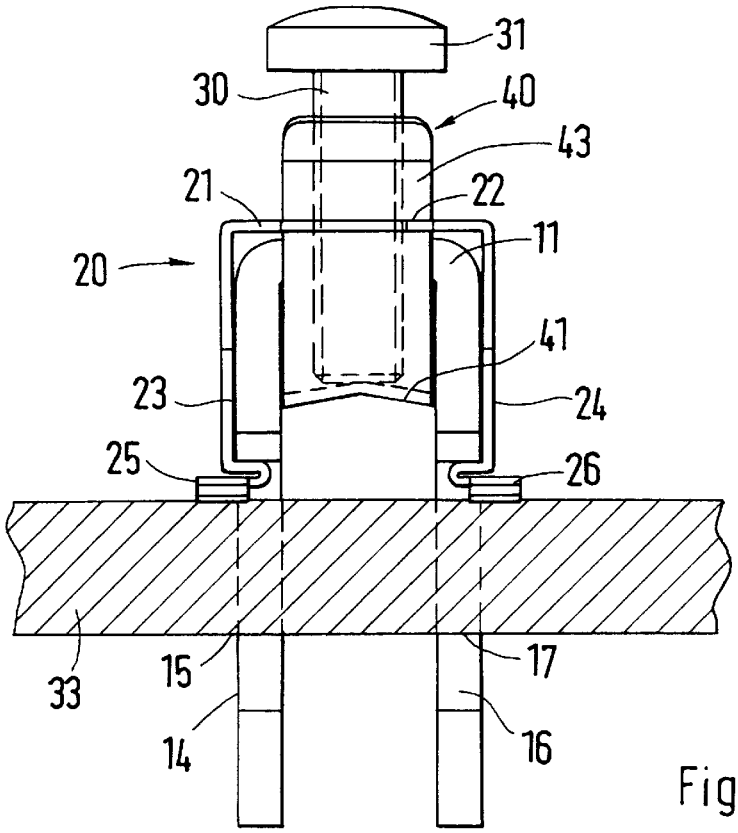
FIG. 2 is a front partial cross-sectional view of a connecting terminal in a hook strap occupied by a busbar.

As shown by the views in FIGS. 1 and 2, a connecting terminal in accordance with one preferred embodiment of this invention comprises a hook strap 10 as a base element, the same as conventional connecting terminals, which has a threaded bore in a transverse leg 11 for an attachment screw 30, which has a screw head 31. Two lateral legs 14 and 16 of the hook strap 10 adjoining the transverse leg 11 are on one side with rectangular receivers 15 and 17 for a rectangular busbar 33.

A holding strap 20 is positioned on the hook strap 10 from a direction of outside of the transverse leg 11 which, with an appropriate cross section, rests against the transverse leg 11 and the lateral legs 14 and 16 of the holding strap 10. A transverse leg 21 of the holding strap 20 has a bore 22 for an attachment screw 30. Lateral legs 23 and 24 of the holding strap 20 are only extended in an area of the receivers 15 and 17 as far as the receivers 15 and 17 and are beveled on the end, constituting holding springs 25 and 26, which project into the receivers 15 and 17. Since the distance between the holding springs 25 and 26 is designed such that their distance is greater than the distance between the inner walls of the lateral legs 14 and 16 of the holding strap 10, but is less than the distance between the outer walls, the holding strap 20 can be locked on the hook strap 10. The holding springs 25 and 26 project into the receivers 15 and 16, so that the holding springs 25 and 26 are supported under tension on and provisionally held by the inserted busbar 33.

The transverse leg 21 of the holding strap 20 extends on both sides past the free sides of the lateral legs 14 and 16 of the hook strap 10 and has slits 27 and 29, which are cut into the extensions 28.

A clamping strap 40 is introduced between the lateral legs 14 and 16 of the hook strap 10, wherein lateral legs 42 and 43 of the clamping strap 40 are inserted into the slits 27 and 29. If the ends of the lateral legs 42 and 43 are at a distance which is greater than the distance between the slits 27 and 29, the clamping strap 40 is captively held on the holding strap 20 because of prestress of the lateral legs 42 and 43. The lateral legs 42 and 43 are sufficiently long so that the clamping strap 40 can move through a maximum adjusting path without loosening from the holding strap 20.

As shown in FIG. 2 in particular, a width of the clamping strap 40 is matched to the clear distance between the lateral legs 14 and 16 of the hook strap 10, so that a sufficiently large receiving space for one or several connecting cables is created between the transverse leg 41 of the clamping strap 40 and the busbar 33.

Figure 3:
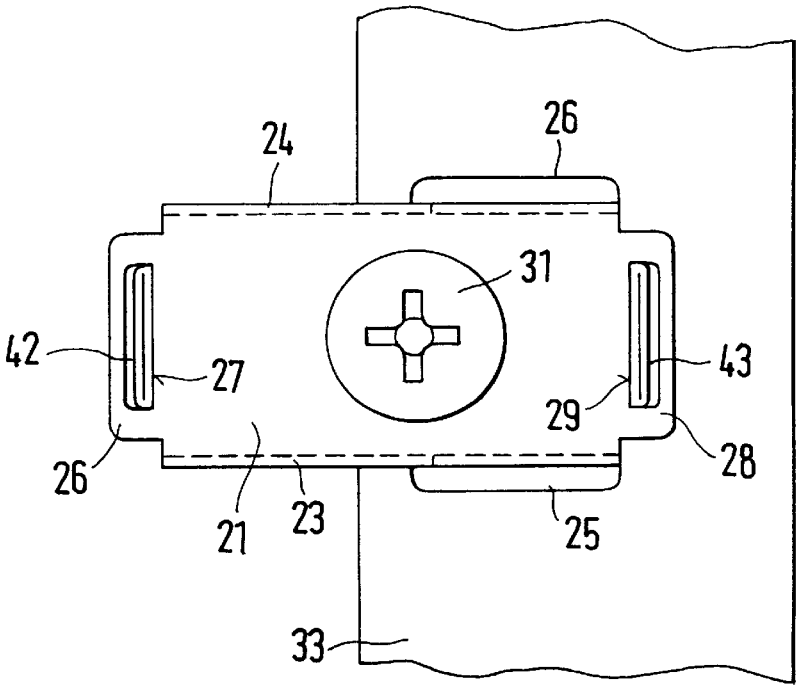
FIG. 3 is a top view of a connecting terminal attached to a busbar.

FIG. 3 shows the connecting terminal fixed on the busbar 33 in a top view. By means of the attachment screw 30, the clamping strap 40 can be displaced between the lateral legs 14 and 16 of the hook strap 10, between the transverse leg 11 of the hook strap 10, and the busbar 33, so that connecting cables of small or large cross sections can be clamped in place and thereby connected with the busbar 33. The lateral legs 42 and 43 of the clamping strap 40 only need to have an appropriate length so that the lateral legs 42 and 43 are held on the holding strap 20 over an entire adjustment path. The guidance and fixing in place of the lateral legs 42 and 43 of the clamping strap 40 on the holding strap 20 can also be provided in other ways. It only must be assured that the clamping strap 40 is captively held on the holding strap 20 over an entire adjustment path, so that it cannot accidently come loose from the connecting terminal.

It is apparent that the connecting terminal comprising the hook strap 10, the holding strap 20 and the clamping strap 40 can be easily assembled. To this end first the holding strap 20 must be locked on the hook strap 10. Then it is only necessary to insert the clamping strap 40 and to connect it with the holding strap 20. This assembly is considerably simpler.

What is claimed is:

1. In a connecting terminal for a busbar and a connecting cable, having a hook strap which can be pushed on the busbar, a clamping strap which can be adjusted by an attachment screw which clamps the connecting cable to the busbar, and a holding strap which provisionally holds the hook strap which is pushed on the busbar, the improvement comprising:

the holding strap (20) urged toward an outside on a hook transverse leg (11) of the hook strap (10) extending with a plurality of holding lateral legs (23, 24), a beveled end of each of the holding lateral legs (23, 24) forming a plurality of holding springs (25, 26) projecting into a plurality of hook receivers (15, 17) of a plurality of hook lateral legs (14, 16) of the hook strap (10), the transverse leg (11) of the holding strap (20) having a through-bore (22) for accommodating the attachment screw (30); and the holding lateral legs (23, 24) of the holding strap (20) extending on both sides of and covering the hook strap (10), hook transverse leg (11) forming a plurality of receivers (27, 29), the clamping strap (40) having a plurality of clamping lateral legs (42, 43), the clamping strap (40) positioned between the hook lateral legs (14, 16) of the hook strap (10), and the clamping lateral legs (42, 43) extending through the receivers (27, 29).

2. In a connecting terminal in accordance with claim 1, wherein the holding lateral legs (23, 24) of the holding strap (20) are inserted only in an area of the hook receivers (15, 17) of the hook lateral legs (14, 16) of the hook strap (10) as far as the area of the hook receivers (15, 17).

3. In a connecting terminal for a busbar and a connecting cable, having a hook strap which can be pushed on the busbar, a clamping strap which can be adjusted by an attachment screw which clamps the connecting cable to the busbar, and a holding strap which provisionally holds the hook strap which is pushed on the busbar, the improvement comprising:

the holding strap (20) urged from a direction of an outside on a hook transverse leg (11) of the hook strap (10) extending with a plurality of holding lateral legs (23, 24) which act as a plurality of holding springs (25, 26) into a plurality of hook receivers (15, 17) of a plurality of hook lateral legs (14, 16) of the hook strap (10), the holding strap (20) having a through-bore (22) for accommodating the attachment screw (30); and a holding transverse leg (21) of the holding strap (20) extending on both sides past the hook strap (10) and forming a plurality of receivers (27, 29) for adjustable fixing of a plurality of clamping lateral legs (42, 43) of the clamping strap (40) inserted between the hook lateral legs (14, 16) of the hook strap (10);

the holding lateral legs (23, 24) of the holding strap (20) inserted only in an area of the hook receivers (15, 17) of the hook lateral legs (14, 16) of the hook strap (10) as far as the area of the hook receivers (15, 17);

ends of the lateral legs (23, 24) of the holding strap (20) having bevels near the hook receivers (15, 17), which simultaneously form the holding springs (25, 26) and hold the holding strap (20) on the hook strap (10); and a plurality of extensions (26, 28) of the transverse leg (21) of the holding strap (20) forming the receivers (27, 29) as slits through which extensions of the clamping lateral legs (42, 43) of the clamping strap (40) are guided.

4. In a connecting terminal in accordance with claim 3, wherein the extensions (26, 28) of the two clamping lateral legs (42, 43) of the clamping strap (40) are at a first distance which is greater than a second distance between the slits (27, 29).

5. In a connecting terminal in accordance with claim 4, wherein a clamping transverse leg (41) of the clamping strap (40) positioned between the hook lateral legs (14, 16) of the hook strap (10) is beveled such that in a direction toward the hook receivers (15, 17) of the hook lateral legs (14, 16) of the hook strap (10) the clamping transverse leg (41) forms an obtuse-angled contact surface.

6. In a connecting terminal in accordance with claim 5, wherein a third distance between the holding springs (25, 26) of the holding strap (20) is greater than a fourth distance between inner walls of the hook lateral legs (14, 16) of the hook strap (10), but less than a fifth distance between outer walls of the lateral legs (14, 16) of the hook strap (10).

7. In a connecting terminal in accordance with claim 6, wherein a width of the clamping strap (40) corresponds to the fourth distance between the inner walls of the hook lateral legs (14, 16) of the hook strap (10).

8. In a connecting terminal in accordance with claim 1, wherein a plurality of extensions (26, 28) of the transverse leg (21) of the holding strap (20) form the receivers (27, 29) as slits through which the clamping lateral legs (42, 43) of the clamping strap (40) are guided.

9. In a connecting terminal in accordance with claim 8, wherein the extensions (26, 28) of the two clamping lateral legs (42, 43) of the clamping strap (40) are at a first distance which is greater than a second distance between the slits (27, 29).

10. In a connecting terminal in accordance with claim 1, wherein a clamping transverse leg (41) of the clamping strap (40) positioned between the hook lateral legs (14, 16) of the hook strap (10) is beveled such that in a direction toward the hook receivers (15, 17) of the hook lateral legs (14, 16) of the hook strap (10) the clamping transverse leg (41) forms an obtuse-angled contact surface.

11. In a connecting terminal in accordance with claim 1, wherein a first distance between the holding springs (25, 26) of the holding strap (20) is greater than a second distance between inner walls of the hook lateral legs (14, 16) of the hook strap (10), but less than a third distance between outer walls of the lateral legs (14, 16) of the hook strap (10).

12. In a connecting terminal in accordance with claim 1, wherein a width of the clamping strap (40) corresponds to a distance between inner walls of the hook lateral legs (14, 16) of the hook strap (10).

* * * * *